United States Patent [19]

Marchitello

[11] 4,059,928

[45] Nov. 29, 1977

[54] DRILL GRINDING ATTACHMENT

[76] Inventor: Raymond Marchitello, 3905 Carpenter Ave., Bronx, N.Y. 10466

[21] Appl. No.: 731,705

[22] Filed: Oct. 12, 1976

[51] Int. Cl.[2] ..... B24B 19/00

[52] U.S. Cl. ..... 51/241 R; 51/219 R

[58] Field of Search ..... 51/219 R, 125, 241 R

[56] References Cited

U.S. PATENT DOCUMENTS

| | | | |
|---|---|---|---|
| 1,388,039 | 8/1921 | Hinz | 51/219 R |
| 2,384,899 | 9/1945 | Dixon | 51/219 R |
| 2,848,852 | 8/1958 | Rosholt | 51/219 R |
| 2,859,569 | 11/1958 | Salmon | 51/219 R |
| 2,932,924 | 4/1960 | Zachow | 51/219 R X |
| 3,341,981 | 9/1967 | Baronyak | 51/219 R |
| 3,703,055 | 11/1972 | Niquet | 51/219 R |

*Primary Examiner*—Harold D. Whitehead
*Attorney, Agent, or Firm*—Richard L. Miller

[57] ABSTRACT

A main frame supports a first shaft rotatably so that a grinding wheel mounted at the end of the shaft may be rotated. A second shaft supports at one end a drill bit holding element for supporting a drill bit which is to be sharpened. The drill bit holding element has a first arm and a second arm for receiving the end of the second shaft, one arm being used in order to sharpen one facet of the drill bit end, and the other arm being used to sharpen the other facet of the drill bit end. A locking frame integrally connected with the arms is telescopically received in a hollow frame, which plate is urged upwardly toward the top surface of the hollow frame to lock in place a drill bit between the top V-shaped surface of the locking plate and the top surface of the hollow frame. A gauge is also provided in the top surface of the hollow frame in order to initially position the drill bit end relative to the grinding wheel surface.

8 Claims, 4 Drawing Figures

DRILL GRINDING ATTACHMENT

BACKGROUND OF THE INVENTION

The present invention is directed to a device for sharpening a drill bit for reuse in a conventional drill. Drill bits wear down after continued use and therefore, lose their effectiveness in penetrating and drilling a hole in a wall or the like. In order to effectuate the drilling of a hole, a new drill bit must be used.

SUMMARY OF THE INVENTION

It is the primary object of the present invention to provide an apparatus for sharpening drill bits for reuse in a drill of conventional design to thereby provide a cost-saving process for those persons owning and using a drill.

It is also an object of the invention to provide for easy mounting of the drill bit to be sharpened in the apparatus of the present invention which allows for fast and accurate mounting of the drill bit.

Still another object of the invention is the sharpening of both facets of the drill bit end by the easy and felicitous repositioning of the drill bit holding element of the present invention relative to the grinding wheel.

The apparatus for sharpening drill bits of the present invention is characterized by a main frame rotatably supporting a first shaft upon which is mounted at one end thereof a grinding wheel for sharpening the facets of a drill bit mounted in the apparatus. The shaft is mounted within a bearing positioned within an opening of the frame. A second shaft is also mounted on the main frame which mounts at one end thereof a drill bit holding element. The drill bit holding element is comprised of a first arm and a second arm each of which has an opening for the reception therein of the second shaft to thereby hold the drill bit in place for subsequent sharpening against the grinding wheel. The first and second arms are joined integrally with a longitudinally extending drill bit locking plate which is urged into contact with the drill bit by a thumb screw. The thumb screw is carried by a hollow frame of rectangular cross-section, with the top surface of the longitudinally extending locking plate having a V-shape cross-section so as to firmly hold the drill bit in place by offering a larger surface contact area.

A guage is also provided which allows for initially positioning the drill bit holding element relative to the grinding wheel, so as to insure proper distancing of the facets of the drill bit from the surface of the grinding wheel. Another guage allows for determining the extension of the drill bit end from the end of the locking plate nearest the grinding wheel.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING

The invention will be more readily understood with reference to the following detailed description, when taken in conjunction with the accompanying figures, wherein.

DETAILED DESCRIPTION OF THE INVENTION

Figure 1:
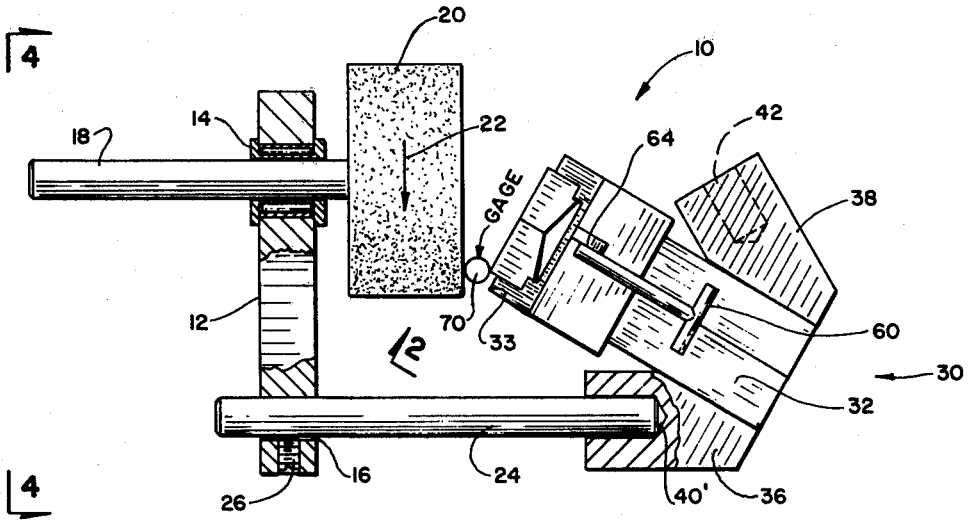
FIG. 1 is a schematic elevational view showing the apparatus for sharpening drill bits of the present invention.

Referring now to the drawing, there is shown in FIG. 1 the apparatus for sharpening drill bits of the present invention. The apparatus 10 is made up of a main supporting frame 12 having a first opening for the mounting therein of a bearing 14, and a second opening 16 for the mounting of a shaft supporting the drill bit holding element to be described below. Rotatably mounted in the bearing 14 is a first shaft 18 which has fixedly mounted at its end a grinding wheel for the sharpening of the facets of the drill bit. The grinding wheel and shaft therefore, are rotated by any well known means. The grinding wheel 20 is rotatable in the direction indicated by arrow 22 in FIG. 1. A second shaft 24 is nonrotatably secured in the second opening 16 by a tightening screw 26 which allows for initial positioning of the drill bit relative to the grinding wheel 20, and supports at its end remote from the supporting frame 12 the drill bit holding element referred to generally by reference character 30.

Figure 3:
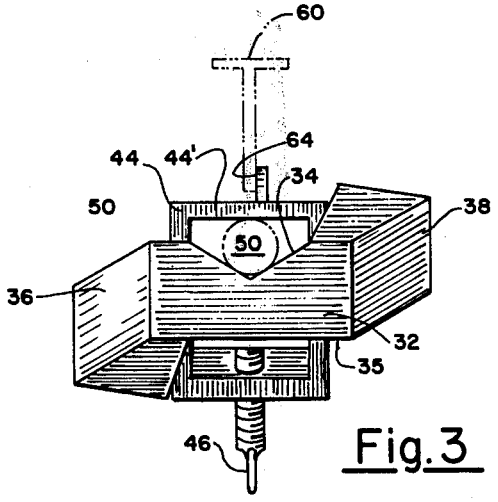
FIG. 3 is an end view taken along line 3–3 of FIG. 2.

The drill bit holding element 30 is comprised of a longitudinally extending drill bit locking plate 32 having a top surface 34 formed into a "V" cross-section, as can best be seen in FIG. 3. Extending from opposite sides of the locking plate 32, and formed integrally therewith, are a pair of mounting arms 36 and 38, with each arm having a longitudinal opening 40, 42, respectively, formed therein for receiving therein the end of the shaft 24 in order to mount the drill bit holding element 30 to the shaft and main supporting frame. As can be seen in FIG. 3, the arm 36 extends downwardly at an angle relative to the locking plate 32, while the arm 38 extends upwardly at an angle relative to the locking plate. This symmetrical positioning of the pair of arms 36, 38, thereby permits for the easy repositioning of the drill bit 50 so that either of the two facets of the drill bit end 52 can be engaged against the grinding surface of the grinding wheel 20.

Figure 2:
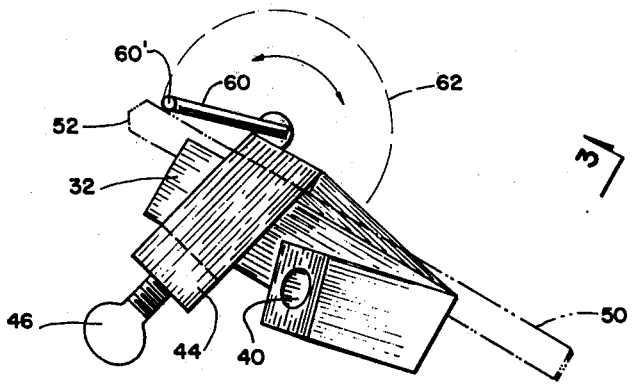
FIG. 2 is a partial cross-sectional view taken along line 2–2 of FIG. 1.
Figure 4:
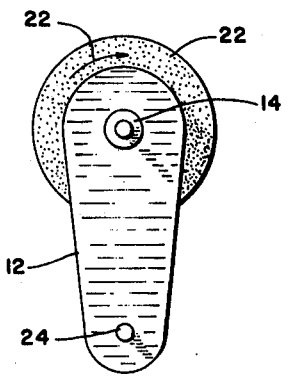
FIG. 4 is a different end view taken along line 4–4 of FIG. 1.

Mounted to the locking plate 32, at its end nearest the grinding wheel 20, is a hollow frame of rectangular cross-section. The hollow frame 44 extends at an acute angle relative to the longitudinally extending locking plate, as can be seen in FIG. 2. The hollow frame 44 is provided with a locking thumb screw 46 for bearing against the bottom surface 35 of the longitudinally extending locking plate so as to urge the top "V"-shaped sufrace 34 into locking engagement with the drill bit 50 which is to be sharpened. The drill bit 50 is positioned between the top surface 34 and the top surface 44' of the hollow frame 44 when locked in place for the grinding of the facets of the end 52. The locking plate 32 locks the drill bit in place as described above by reason of its telescoping arrangement with the hollow frame 44. As can be seen in FIG. 2, the hollow frame 44 is slidable relative to the locking plate 32 both in the longitudinal and vertical directions when the thumb screw 46 is in its lower, disengaged position. In order to insure the greatest possible locking action, the hollow frame 44 is positionable at the angle described above.

Pivotally mounted on the top surface 44' of the hollow frame 44 is a guage 60 pivotable along the arc indicated by reference character 62. The guage 60 is mounted to the top surface 44' by means of a conventional pivot 64. The guage 60, when rotated to its forward-most position, as shown in FIG. 2, indicates the position the drill bit end 52 should be when locked in place so as to extend just enough beyond the locking plate so as to contact the grinding wheel 20.

In use, the drill bit holding element 30 is first mounted to the shaft 24 via one of the arms 36 and 38. Then, the drill bit to be sharpened is inserted through the hollow frame 44 between the top surface 34 of the locking plate and the top surface 44' of the hollow frame 44 until the end 52 of the drill bit 50 pivots the guage 60 upwardly so that the end 60' of the guage is coextensive with the end 52. Thereupon, the locking thumb screw 46 is tightened to its raised locking position thereby locking the drill bit in place between the top surfaces 34 and 44'. The initial positioning of the arm 36 or 38 on the shaft 24 is aided by a second guage 70 which indicates when the bottom edge surface 33 of the locking plate is positioned the right distance away from the grinding wheel surface, so as to allow for wear of the grinding stone and the proper functioning of the guage 60 relative to the drill bit end 52.

The guage 70 first indicates the point where the second shaft 24 should be fixed in the frame 12 by the screw 26. Only after the shaft 24 is finally positioned, relative to the grinding wheel will the guage 60 function properly.

When the first facet of the end 52 has been sharpened, the holding element 30 is removed from the shaft 24. Then, the holding element is rotated 180 degrees so as to bring the other of the arms 36 and 38 along side the end of the shaft 24 for insertion into the corresponding opening of the other arm in order to sharpen the second facet.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Apparatus for sharpening drill bits for use in a drill, said drill bit having an end with two facets to be sharpened, comprising, in combination: a main frame; a first shaft rotatably supported by said main frame near one end thereof; a second shaft substantially parallel to the first shaft and fixedly supported in said main frame near the other end thereof; a grinding wheel rotatably mounted on one end of said first shaft for sharpening said facets of said drill bits; means for rotating said grinding wheel; and a drill bit holding element mounted on one end of said second shaft for holding said drill bit therein, said holding element being positioned such that said drill bit has its facets in close proximity to the flat surface of said grinding wheel, whereby said facets are sharpened for subsequent reuse, and wherein said drill bit holding element comprises a longitudinally extending locking plate having a first end and a second end, said second end being adjacent said grinding wheel, a first arm and a second arm divergingly extending from opposite side of said first end of said locking plate, each of said first and second arms having an elongated opening formed therein for receiving said one end of said second shaft, whereby either one of said first and second arms may be attached to said second shaft for sharpening one or the other of said two facets of said drill bit, and wherein said first arm extends downwardly at an angle relative to said first end of said locking plate, and said second arm extends upwardly at an angle relative to said first end of said locking plate.

2. The apparatus according to claim 1, wherein said drill bit holding element further comprises a hollow frame of rectangular cross-section, said locking plate passing through said hollow frame, said hollow frame having means for urging said locking plate upwardly toward the top surface of said hollow frame in order to lock said drill bit positioned therebetween in place for subsequent sharpening by said grinding wheel.

3. The apparatus according to claim 2, wherein said locking plate comprises a top surface having a "V" shaped cross-section for supporting therein said drill bit to be sharpened, said means for urging said locking plate upwardly comprising a thumb screw mounted for reciprocable movement in the bottom surface of said hollow frame.

4. The apparatus according to claim 3, wherein said hollow frame extends at an angle relative to the longitudinal axis of said locking plate, said hollow frame being positioned along said locking plate near said second end of said locking plate, said second end of said locking plate lying in close proximity to said grinding surface of said grinding wheel.

5. The apparatus according to claim 4, wherein said holding element further comprises means for indicating the proper extension of said drill bit end from said second end of said locking plate, so that said drill bit end is positioned correctly relative to said grinding surface of said grinding wheel.

6. The apparatus according to claim 5, wherein said means for indicating comprises a pivotal arm pivoted to the top surface of said hollow frame, said pivotal arm being movable from a first rest position on said locking plate to a second indicating position where the end of said pivotal arm indicates the extent of said drill bit end from said second end of said locking plate.

7. The apparatus according to claim 6, wherein said main frame comprises means for locking said second shaft in place and means for rotatably supporting said first shaft.

8. The apparatus according to claim 7, further comprising a guage for positioning said second shaft relative to said means for locking so that said drill bit holding element is positioned properly relative to said grinding surface and so that said pivotal arm can function properly.

* * * * *